US005742936A

United States Patent [19]

Tronc

[11] Patent Number: 5,742,936

[45] Date of Patent: Apr. 28, 1998

[54] TIGHT-FITTING GARMENT, NOTABLY FOR SPORTSWEAR SUCH AS DIVING SUITS

[76] Inventor: Nicolas Tronc, 46 Rue des Francs Bourgeois, 75003 Paris, France

[21] Appl. No.: 787,285

[22] Filed: Jan. 24, 1997

Related U.S. Application Data

[63] Continuation-in-part of Ser. No. 244,963, Aug. 18, 1994, Pat. No. 5,603,116.

[51] Int. Cl.[6] ..... A41D 13/00

[52] U.S. Cl. ..... 2/2.15; 2/69; 2/159; 2/161.1; 2/239

[58] Field of Search ..... 2/2.15, 2.16, 2.17, 2/69, 272, 239, 79, 97, 82, 101, 115, 90, 108, 67, 227, 159, 161.1, 161.6, 161.7, 164, 167, 168; 36/98, 113, 138, 8.1, 7.3, 4

[56] References Cited

U.S. PATENT DOCUMENTS

| | | | |
|---|---|---|---|
| 2,976,539 | 3/1961 | Brown | 2/97 |
| 2,990,550 | 6/1961 | Locketz | 2/97 |
| 4,276,341 | 6/1981 | Tanaka | 2/2.16 |
| 4,420,521 | 12/1983 | Carr | 2/272 |
| 4,438,531 | 3/1984 | Long et al. | 2/2.15 |
| 4,569,874 | 2/1986 | Kuznetz | 2/272 |
| 4,783,858 | 11/1988 | Chevalier | 2/272 |
| 4,946,453 | 8/1990 | Monson | 2/2.15 |
| 5,033,116 | 7/1991 | Itagaki et al. | 2/2.15 |
| 5,098,770 | 3/1992 | Paire | 2/272 |
| 5,201,074 | 4/1993 | Dicker | 2/239 |
| 5,244,716 | 9/1993 | Thornton et al. | 2/239 |
| 5,323,490 | 6/1994 | Yarbrough | 2/161.7 |
| 5,539,928 | 7/1996 | Aldridge | 2/97 |
| 5,590,420 | 1/1997 | Gunn | 2/239 |

FOREIGN PATENT DOCUMENTS

| | | | |
|---|---|---|---|
| 1379022 | 10/1964 | France . | |
| 2642277 | 8/1990 | France . | |
| 1 268 008 | 5/1968 | Germany | 2/2.15 |
| 87 08 364 | 9/1987 | Germany . | |
| 891998 | 3/1962 | United Kingdom | 2/2.16 |
| 978961 | 1/1965 | United Kingdom | 2/2.16 |
| 1313790 | 4/1973 | United Kingdom | 2/2.15 |

*Primary Examiner*—Amy B. Vanatta

*Attorney, Agent, or Firm*—Merchant, Gould, Smith, Edell, Welter & Schmidt, P.A.

[57] ABSTRACT

The disclosure is related to tight-fitting garments. It can be applied especially to diving suits as well as to riding boots and dish washing gloves. More generally, the disclosure can be applied to all types of garments whose tight-fit makes it difficult to put on or take off in water environment. The disclosure therefore relates to a tight-fitting garment of the sportswear type such as a diving suit, comprising an external layer made of a material having characteristics of adherence. This garment cooperates with at least one strip of film of non-porous material entirely fixed internally in contact with at least one surface portion of said tight-fitting garment.

10 Claims, 2 Drawing Sheets

TIGHT-FITTING GARMENT, NOTABLY FOR SPORTSWEAR SUCH AS DIVING SUITS

This is a Continuation-in-Part of U.S. patent application Ser. No. 08/244,963, filed Aug. 18, 1994 U.S. Pat. No. 5,603,116.

BACKGROUND OF THE INVENTION

1. Field of the Invention

The invention is related to tight-fitting garments, notably but not exclusively garments used in certain sports such as for example underwater diving (or any other aquatic sport requiring the use of a suit, gloves or shoes).

The invention is particularly suitable for diving suits as well as for shoes, boots and gloves in water environment.

More generally, the invention can be applied to all types of garments whose tight-fit makes it difficult to put on or take off.

2. Description of the Prior Art

It is known that it is fairly difficult to pull on a diving suit, notably because of its shape and its elasticity. Similarly, when a diver removes a diving suit, after having come out of the water, he has to make considerable efforts to get himself out of the suit.

The reasons for these difficulties can be found in several phenomena.

First of all, the constituent materials of the tight-fitting clothes are generally elastic and are stretched when worn by the user. It is this elasticity that gives the garment its tight-fitting character, but it also increases the forces of friction between the garment and the body when it is put on or taken off.

Furthermore, these materials are often of a porous type, for example neoprene for divers'suits or surfers' suits. Now, the pores of this material tend to expand in contact with the heat of the body. This gives rise to a sort of suction effect between the tight-fitting garment and the undergarments or the skin. This suction effect is increased by perspiration and by the possible penetration of sea water into the garment (in the case of a nautical sports suit), by external surface pressure when the garment is used in an underwater environment and probably also by the user's movements which contribute to the expulsion of air that may be trapped in the interstices when the garment is pulled on.

Besides, when the wearer comes out of the water, the water held between the suit and the body runs out almost entirely through the ends of the suit. However, because of the quantity of water remaining (through absorption by the material), the suit continues to adhere strongly to the skin by the same suction effect.

Users generally try different ways of putting on or removing their suits more easily. One of the known approaches consists in removing the suit while remaining in the water. However, with this method, not only is there very little reduction in the adherence but, furthermore, the difficulty of the operation in itself is often further increased.

Another approach consists in lubricating the interior of the suit. The lubrication, which is done for example with soap or a washing-up liquid, is not very effective and furthermore causes pollution. In general, the use of a lubricant is disagreeable and often ineffective, generally causes pollution, and is sometimes even chemically harmful to the body and the material constituting the suit.

The patent FR-A-1 379 022, filed on 8 Oct., 1963 by Dubois and Beraud, describes a latex garment molded to the desired shape, to the back of which there is bonded a flexible and highly stretchable undervest. This undervest makes the garment pleasant to wear and preserves the heat of the body.

This document specifies that the undervest lining can be coated with a thin layer of plastic (or other material) to make it easier to pull on and prevent contact between the undervest lining and the skin.

However, a garment of this kind has numerous drawbacks. Thus, the fact that the skin slides on the thin layer of plastic (or other material), while it makes the garment easy to pull on, also means that the body is not held securely in the garment (the suction effect does not exist in this case) and may accidentally slip inside this garment.

Furthermore, a garment of this kind, wherein the skin is in contact with only a thin layer of plastic, does not permit the removal of perspiration where it is needed for comfort.

Consequently, it can clearly be seen that, during intense physical effort, as is the case in underwater diving, wearing a garment such as this is neither safe (since the body is not securely held) nor pleasant.

An object of the invention notably is to overcome these different drawbacks of the prior art.

More specifically, an object of the invention is to provide means that make it easy to pull on as well as to remove a tight-fitting garment of the sportswear type, for example an underwater diving suit.

It is also an object of the invention to provide a tight-fitting garment than is pleasant to wear and holds the body in a perfectly secure way despite intense physical effort.

Another object of the invention is to provide means that are simple to use and cost little.

SUMMARY OF THE INVENTION

These objects, as well as others that shall appear hereinafter, are achieved according to the invention by means of a tight-fitting garment, for example a diving suit, comprising: an external layer made of material having characteristic of adherence and arranged to cling closely to a wearer's body, and at least one internal strip of a film of non-porous material, deprived of any holes, extending longitudinally in the direction of removal by the wearer, said strip of film having an exterior surface in the direction of the wearer body of a predetermined dimension of slippery texture and having an interior surface being secured by gluing to an internal portion of said external layer, said strip of film being arranged to extend in surface contact with an area of the body, said area of the body being an area of increased frictions with said tight-fitting garment when putting on or removing said tight-fitting garment.

Thus, the film of non-porous material improves sliding quality when a tight-fitting garment such as this is pulled on or removed.

The predetermined dimension of the surface of the slippery non-porous material is arranged to allow the presence of a thin film of water which may both keep the warmth of the body and/or improve slidability, playing the role of a lubricant.

Finally, in the other parts of the garment not covered with the plastic films, the body is in direct contact with the material having characteristics of adherence. Consequently, with an accurate choice being made of the size and position of these films, the body will as well be held perfectly securely in the garment.

Advantageously, the strips of film are made of plastic material and fixedly joined to said internal portion of the external layer by gluing on its entire or whole surface after a surface treatment of said film.

In a preferred embodiment, said film of non-porous material is made of a plastic material fixedly joined to the tight-fitting garment by application of a layer of glue between said film and said external layer, after a surface treatment of said film with a plasma process.

In an embodiment the film for improving slippery is provided separately and can be applied by the wearer himself on the specific internal parts of the garment chosen by said wearer.

Advantageously the strip of film is removable, at least once, therefore allowing adjustment of its position by the wearer.

In another embodiment, the film is obtained by a layer of glue which provides a slippery exterior surface when solidified or cured.

Advantageously, said tight-fitting garment is of the type belonging to the following group: jackets, shorts, trousers or vests.

According to a preferred embodiment of the invention the garment is a boot.

According to another preferred embodiment the garment is a glove, for instance for dish washing.

Advantageously, said garment has elastic tightening means at its ends.

Advantageously, the film is entirely fixed to the internal part of the garment, on the whole surface of said film.

Advantageously, the tight-fitting garment includes means for being joined to an undergarment. Thus, after the tight-fitting garment has been pulled on easily owing to the films, the fact that these two garments are joined together prevents subsequent sliding motions if any and ensures that the body will be held securely in a corresponding tight-fitting garment. Indeed, a suit for example, should always be fixed with respect to the body and should be a second skin so to speak. If not, in moving, the suit would become cumbersome.

Advantageously, whatever the embodiment chosen, said non-porous material is a polyethylene.

Furthermore, the invention also relates to a glove comprising a film applied internally in contact with at least one of the regions of the body belonging to the group comprising the palm and the back of the hand.

The invention also relates to a shoe or a boot comprising a film applied internally in contact with at least one of the regions of the body belonging to the group comprising the sole, the heel and the top of the foot.

In this way, whether it is for the glove or for the shoe respectively, the film of non-porous material placed on only certain parts of the hand or of the foot respectively makes it possible to preserve the sliding of the skin on the film of non-porous material and therefore makes it easy to pull on or remove the glove or the shoe respectively.

Furthermore, this also enables the hand or the foot to be held securely since, in certain places (the fingers and the toes), the skin is in direct contact with the external layer made of a material having characteristics of adherence.

BRIEF DESCRIPTION OF THE DRAWINGS

Other features and advantages of the invention will appear from the following description of preferred embodiments of the invention, given by way of a non-restrictive example, and from the appended drawings, wherein.

MORE DETAILED DESCRIPTION

The garments described here below relate mainly to underwater diving. It is also and more applicable generally for boots and shoes, involving wet environments, i.e. contact with water.

The diver encounters many difficulties in pulling on his or her suit. Indeed, the external layer of the suit is made of a material, neoprene for example, having characteristics of adherence.

To make it easy to pull on the suit, the invention is based on the idea of greatly reducing the effect of adherence, usually encountered, by the adjoining of a complementary sliding element.

In a first embodiment described here below, the complementary sliding element is a film without any holes or gaps made of a non-porous material that is fixedly joined on its entire surface of contact by gluing to the tight-fitting garment and facilitates the sliding of the unit formed by the garment and the film against the skin.

Figure 1:
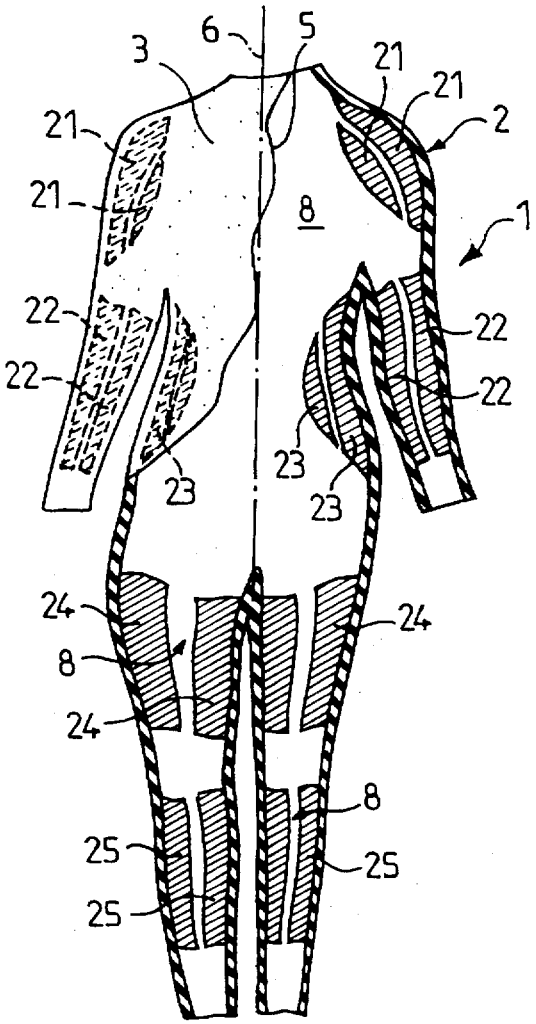
FIG. 1 shows an exploded view of a diving suit according to an embodiment of the invention.

The suit 1 in one piece as represented in FIG. 1, shows a plurality of bands of film 2 of non-porous material, herein a macromolecular plastic, that at least partially lines he interior of the suit. Indeed, in this figure, a part of the external layer 3 of the suit has not been shown. A line 4 demarcates this part which is not shown. The bands of film 2, in plastic material such as polyethylene, shown by means of hatched lines, enables the skin to slide against the garment when a suit of this kind is pulled on or taken off.

More precisely, FIG. 1 shows for example, symmetrically disposed with regard to the axis 6 of the garment which is a diving suit with legs and sleeves and fixed to the internal surface of the external layer 3 of said diving suit, two first sets of first bands 21 arranged to surround the shoulders of the wearer, each including four bands, two second sets of band 22 substantially in the shape of the sleeves arranged to facilitate the sliding of the sleeves of the garment to which they are fixed with regard to the forearms and four third sets of bands 23 (in interrupted lines on the figures) arranged to facilitate the pulling of the garment from the hips.

More precisely the bands or strips of slippery material are advantageously disposed on the forearms along in French language the "grand palmaire", the "supirateur" (above), the "cubia antérieur" and the "extenseurs communs" (below).

Concerning the arms, they may be disposed along the biceps and the triceps.

The extremities of the arms of the suit will be without any slippery bands on for instance 5 cm, in order to keep the tightness of the suit along the wrist.

Concerning the head and the neck, it exists two possibilities.

If there is no howl no strips should be provided, to keep the correct tightness around the neck.

In case of howl, the two guiding lines for installing the strips are placed between the attach of the muscles and the sternocléido-masoïdien. A line from the top of the head to the 7th cervical vertebra is also provided with a strip.

The type of suit and the way it is closed shall also involve different ways of installing the strips.

Advantageously, the strips 2 will generally be of between 4 and 10 cm of width, 10 to 20 cm of length and with a thickness between 0,5 mm and 10 μ, for instance 0,1 mm.

Additionally, the suit 1 of FIG. 1 comprises two sets of three stripe 24, one set for each thigh, and two sets of three strips 25, one set for each leg.

Three lines or ridges of the thigh and leg are covered by a strip, i.e on one part one for the quadriceps (on the front of the thigh) and two for the "crural" muscle and the "adducteurs" in French language (on the back of the thigh), and on the other part one for the tibia (on the front of the leg) and two for the "jumeaux interne et externe" in French language (on the back of the leg).

More generally, depending on the fact that some diving suits are in two pieces, for instance with an opening around the waste, other slippery zones may be advantageously determined by trying. The wearer may then stick himself the slippery bands or strips on the relevant internal zones of the suit, according to his morphology.

A sufficient part of the surface of the external layer 1, for instance between one third and nine tenth of the surface of the body of the wearer, and more particularly between three quarter and nine tenth of said surface, are without films, therefore providing important gaps where the skin of the wearer is in direct contact with the external layer which allows perspiration.

This provides a better heat isolation when diving in deep waters without decreasing substantially the comfort of the wearer.

Figure 2:
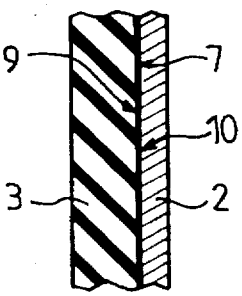
FIG. 2 is a sectional view of a portion of a suit with a film according to an embodiment of the invention.

FIG. 2 shows a schematic sectional view of a portion of a suit as shown in FIG. 1. The external layer 3 made for instance of neoprene has characteristics of adherence due to a specific treatment which will be described hereafter. The external layer 3 is fixed via a layer 7 of glue with the strips of plastic film 2 made for instance with polyethylene. Thus, when a suit such as this is pulled on, the skin slides against the strips plastic 2.

More generally, the strips of film 2 is made of plastic or any non-porous material enabling the skin to slide well against it.

The fixation may be obtained by a bicomposite glue layer for instance a glue manufactured by the American firm 3M under the reference DP105 or DP110 deposited by spreading, or a glue deposited by spraying on the entire surface of contact between the film and the internal surface of the external layer 3.

In the embodiment shown, gaps 8 are provided and have a size of the order of between a few $mm^2$ and several $cm^2$. These gaps 8 can be used to remove the perspiration as well as of water located between the strips of film 2 and the skin.

In one embodiment, no gaps are provided between the strips, therefore always keeping a layer of water between the relevant part of the body and the suit, which is isolating said body from the environment. In this case, some elastic tightening means 9 are provided at the ends of the garment.

It is now described more precisely one preferred embodiment of a film according to the invention. The interior surface 9 (see FIG. 2) of the film 2 which shall cooperate with the internal face 10 of the external layer, has been treated, previously to the gluing, by a cold plasma.

A cold plasma is a low pressure gas which has been partially or totally ionized, due to electromagnetic discharges.

The treatment of the film in polyethylene has been for example using air as the plasma gas ($O_2/N_2$ 20%/80%), with a low pressure (i.e. 2 mbar) a power of 50 Watts and a duration of the treatment of 2 min.

The plasma reactor was of the type R300 Plasma Electronique with a discharge in situ having a frequency: 13,56 MHZ.

The glue which could be spread with a thickness of the layer 7 controlled add maintained below a certain value, for instance ore or two microns or a few tenth of micron, or sprayed, is for instance a polyurethane glue or a neoprene glue either a bicomponent glue which could be spread or a monocomponent glue, which can be sprayed.

A polyepoxyde glue is also possible.

The glue should be chosen in the manufacturer catalogs for its good reaction in sea environment, under pressure and against UV irradiation, and also concerning washing and physical and chemical stability during the life of the suit.

Such glue should have good resistance in water and sea environment.

As explained more specifically hereinafter for the gloves and the shoes, the film 2 of non-porous material can also have large-sized holes or gaps locally.

At the positions of these holes or gaps, the skin is in direct clinging contact with the material having characteristics of adherence. Through an accurate choice of these positions (positions corresponding for example to the fingers, toes, heels, shoulders, etc.), the body is held in a perfectly secure way in the garment.

The gloves and the shoes could be accessories for a diving suit.

But the invention is not limited to such embodiment and is particularly suitable and directed to boots such as riding boots, or gloves such as dish washing gloves.

Figure 3A:
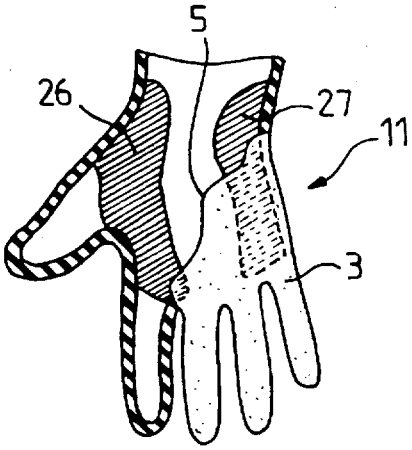
FIGS. 3A and 3B show two exploded views of the sides of a glove according to the invention.
Figure 3B:
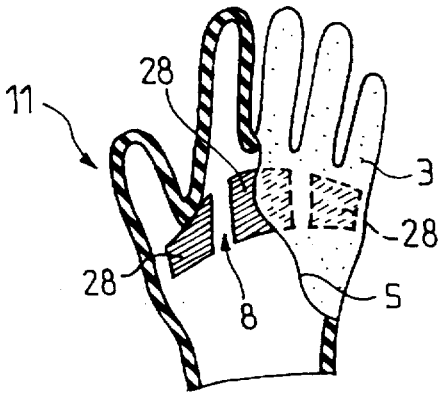

In FIGS. 3A and 3B, as in FIGS. 1 and 2, a part of the external layer 3 (generally) made of neoprene is not shown. A line 5 demarcates that part of the external layer 3 that is shown from the part that is not shown, revealing the strips of plastic film 2.

More particularly, FIG. 3A shows the palm part of a glove 11 having two strips, one elongated strip 26 covering the portion corresponding substantially to the muscle of the thumb and one strip 27 corresponding to the other side of the hand related to the little finger.

FIG. 3B shows the upper part of the glove 11, with three strips 28 substantially rectangular, covering the articulations with the fingers, for instance three rectangulars.

So that the glove does not slip accidentally when it is put on, the strips of film 2 are separated by gaps 8 and does not entirely cover the interior of the glove.

For instance, the strips may also be constituted by three rectangular bands, i.e. one lateral band on the palm near the attach of the fingers and lateral bands on each side of the hand.

Figure 4:
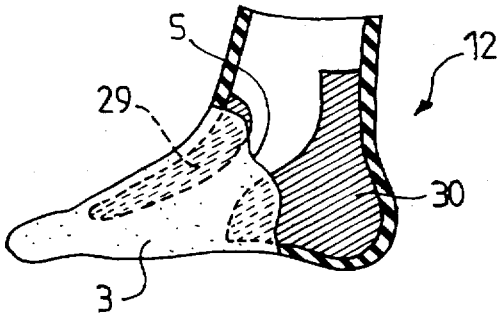
FIG. 4 shows a shoe according to an embodiment of the invention with a part of the external layer of the shoe not shown.

FIG. 4 shows a shoe 12. Only that part of the shoe corresponding to the top of the foot 29 and the sole 30 is covered internally with a strip plastic film.

The suit, glove and shoe shown respectively in FIGS. 1, 3A and 3B, and 4 are easy to pull on because the skin is not in contact with the neoprene 1 but with a band or strip of plastic film 2 against which it slides easily. So that a member of the body can be held securely in a corresponding garment (the body in the suit, the hand in the glove or the foot in the shoe), the strips of plastic film are separated by gaps 8 and does not entirely line the interior of said garment. The fingers and the toes, for example, are in direct contact with the neoprene thus preventing the glove or the shoe from accidentally slipping.

It is also possible to provide undergarment, with the garment of the invention.

If necessary, it can be seen that the garments and the undergarments are connected to one another at several end points (at the wrists or ankles) to prevent them from being mismatched or lost.

Whatever the embodiment chosen, whether it is a tight-fitting garment lined internally with a film of non-porous material or an undergarment comprising an external film of non-porous material, the choice of oriented polyethylene as a non-porous material is advantageous.

Indeed, if care is taken to orient the polyethylene film along an axis perpendicular to the axis of the tensile forces exerted when the suit or the associated accessories are put on or taken off, the solidity of the polyethylene film is improved and it is prevented from tearing or getting out of shape.

The gaps 8 enable the removal of the perspiration as well as the water located between the film 2 and the skin. Furthermore, these gaps or holes (when they are large-sized), can be used to hold the body securely in the tight-fitting garment while permitting direct contact between the skin and the material having qualities of adherence.

It should also and however be mentioned that in the present invention the strips of film, which can also be portions of glue layer with slippery surface, do not have any small holes or gaps, but on the contrary is entirely slippery with a surface in one piece.

Concerning the application of the glue, such glue can either be applied on the strip of film, before gluing it to the suit, or applied on the internal part of the suit.

In case of using only such slippery glue, without additional layer of plastic, it could be easily applied with rigid pieces having holes corresponding to the surface to be rendered slippery.

Figure 5:
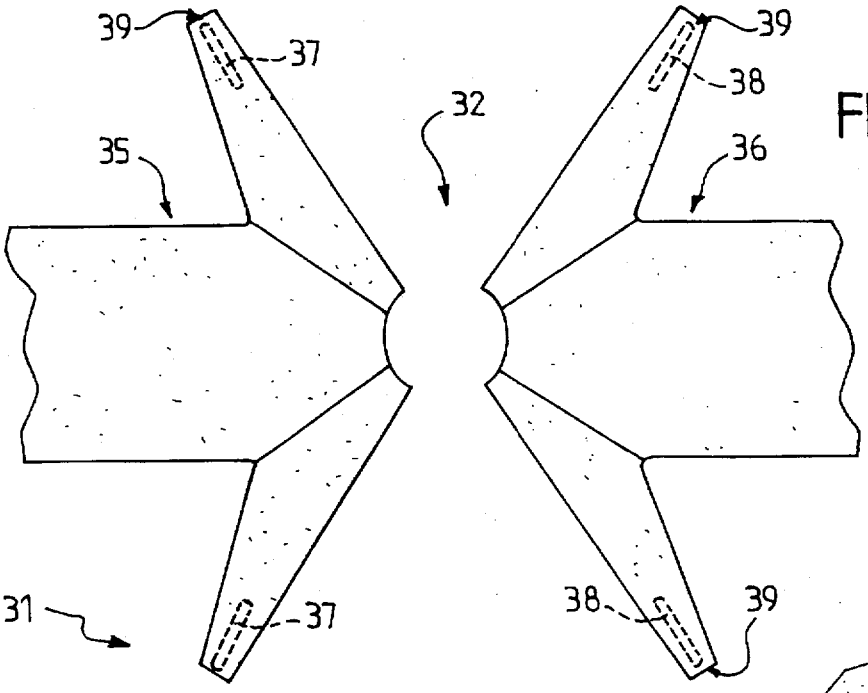
FIGS. 5 and 6 show respectively the vest and the trousers of a diving suit according to the invention.
Figure 6:
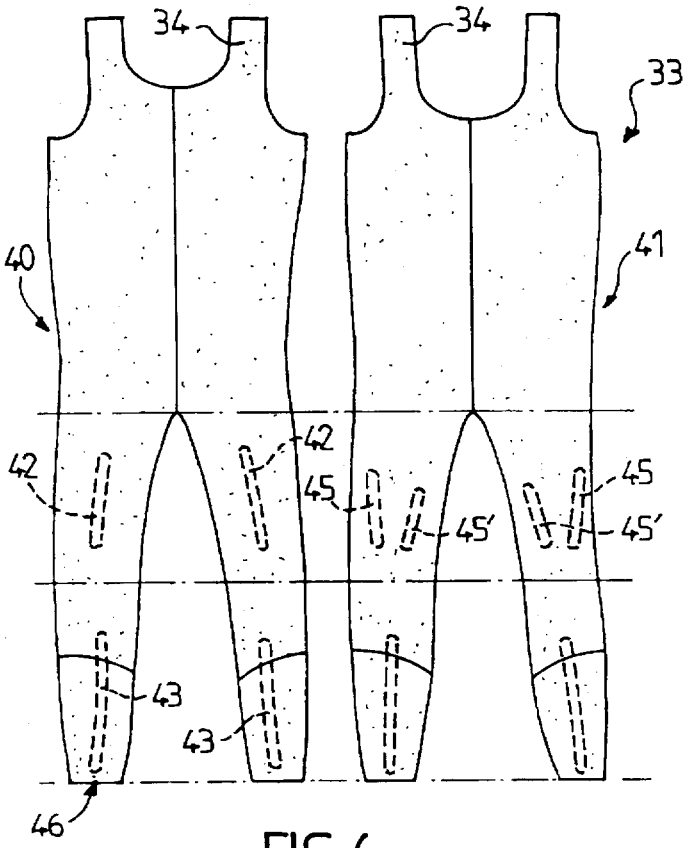

FIGS. 5 and 6 show an other embodiment of a diving suit according to the invention.

It comprises a vest 32 in neoprene and trousers 32 with suspender 34.

More particularly, FIG. 5 discloses the front part 35 and the back part 36 of the vest.

The vest has sleeves, each having strips 37, 38 of a length comprised between 10 cm and 30 cm, for instance of the order of 20 cm, and a width comprised between 2 cm and 10 cm, for instance of 4 cm, one strip 37 on the interior part of the suit directed to the above part of the forearm of the wearer, and one strip 38 on the interior part of the back part of the forearm of the wearer. A gap 39 without any slippery material is provided at the wrists.

The thickness for the strip is for instance of 80 μ.

FIG. 6 shows the back part 40 and the front part 41 of the trousers 33.

Each leg of the back part comprises on the internal surface of the suit in direction of the thigh a strip 42 of between ten and thirty centimeters of length and around 3 cm of width, and on the leg a similar strip 43.

The front part has, on the internal part of each leg one similar strip 44 and, in front of the back part of the thigh two strips 45, 45' slightly at angle with each other, in order to be in contact with the muscles of the thigh, when contracted.

Strip 45 is for instance a little bit longer than strip 45', i.e. 20 cm instead of 15 cm, with a width of 3 cm.

A gap 46 (5 cm large) is provided at the ankles to keep tight fitness therefor.

Figure 7:
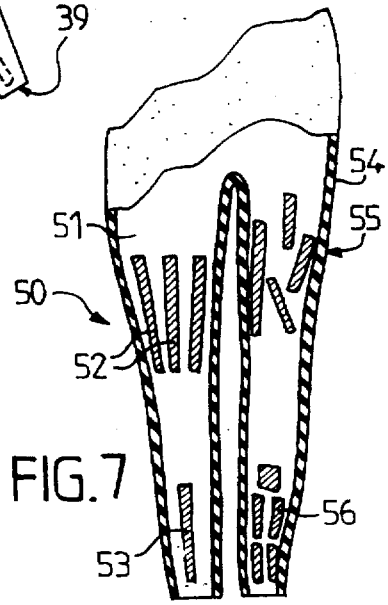
FIG. 7 is a sectional view of the trousers of diving suit showing several ways of installing the strips or bands of film according to the invention.
Figure 8:
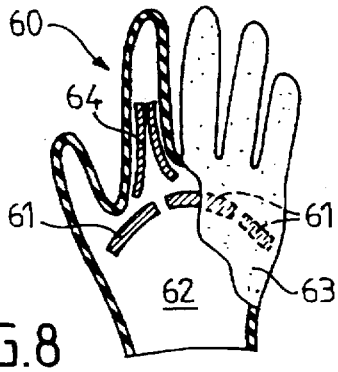
FIG. 8 is a sectional view of a glove showing an other disposition of strips of film according to the invention.

FIGS. 7 and 8 show different arrangements of the strips which have been disposed by the user according to his need. They may have been provided separately at the origin and placed by the user on his first use, after trying the suit without any slippery bands in order to identify clearly the friction points on his own body, which may differ from the ones of an other person.

Advantageously, such strips are fixed definitively at first installation, or may tolerate unsticking and resticking once or twice, if removed immediately before complete solidification of the glue.

FIG. 7 shows in sectional view the legs 50 of a diving suit. Left leg 51 (on the figure) shows additional strips 52 on the thigh which may be more difficult to remove, and only one strip 53 on the leg, which may for instance be easier, as less thick, to withdraw.

Right leg 54 shows four small strips 55 substantially disposed, as claimed in the invention, longitudinally, and parallel to the axis of the body of the wearer, on the thigh part, and several small strips 56 on the leg part, which may have been added successively, after several tries and diving experiences.

FIG. 8 shows the upper part of a glove 60 with strips 61 internally disposed on the internal surface 62 of the external layer 63 of said glove.

The strips 61 are disposed at the junction with the fingers on a circle, and are 5 cm long and 2 cm large.

Two small strips 64 of 6 cm long and 1 cm large are also provided along the attach of the forefingers, which may be difficult to remove for this particular wearer.

Additionally, the width of a strip or a band can be optimized, according to the invention, in order to keep good elasticity of the suit, together with slipping facilities.

The force for having an elongation is ΔL of a sample of length=$L_i$ is as follows:

$$F=k_1\Delta L/L_i+k_2\Delta L$$

$k_1$: constant of the material used for the external layer.

$k_2$: elasticity or compliance constant of said material.

The force due to friction is:

$f=k_3$ S.P.

$k_3$: friction coefficient of the material.

S: surface of contact.

P: pressure on the surface.

The total force is therefore:

$$F=k_1\Delta L/L_i+k_2\Delta L+k_3S.P.$$

having $k'_3$: friction coefficient on the strip of slippery material and l: the width of the strip with:

$L_i1$: length of material without strip $L_i2$: length of material with strip and $L_{i2}=L_{i1}-1\rightarrow L_{i2}=aL_{i1}(a<1)$ The maximum a, for a given external layer and for a specific use $L_{i1}$, $k_1$, $k_2$, $k_3$, $k'_3$, S and $\Delta L$ will be as follows:

$$a < \frac{k_1 \cdot \Delta L \cdot (1 + sk'_3)/L_{i1}}{k_1 \cdot \Delta L \cdot (1 + Sk_3)/L_{i1} - Sk_2 \cdot \Delta L(k_3 - k'_3)}$$

The invention is in no way restricted to the arrangement of holes or gaps as presented with reference to Figures 1 to 8.

The above description relates mainly to garments used for underwater diving. It is clear however that the invention can be extended to any other type of garment whose tight fitting to the body makes it difficult to put on or take off, mainly in water environment.

The different garments according to the invention naturally have characteristics proper to the needs and/or functions related to their respective uses. Thus, it is possible to envisage many adaptations for garments of this kind without departing from the context of the invention.

I claim:

1. A tight-fitting garment comprising: an external layer made of material having characteristics of adherence and arranged to cling closely to a wearer's body, and at least one internal strip of a film of non-porous material, deprived of any holes, extending longitudinally in the direction of removal by the wearer, said strip of film having an exterior surface in the direction of the wearer's body of a predetermined dimension of slippery texture, said strip of film having an interior surface being secured by gluing on an internal portion of said external layer, said strip of film being arranged to extend in surface contact with an area of the body, said area of the body being an area of increased friction with said tight-fitting garment when putting on or removing said tight-fitting garment.

2. A tight-fitting garment according to claim 1, wherein the strip of film is made of plastic material and fixedly joined to said internal portion of the external layer, on the whole interior surface of said strip of film.

3. A tight-fitting garment according to claim 2, wherein the strip of film is fixedly joined to said internal portion by gluing after a surface treatment of said film.

4. A tight-fitting garment according to claim 3 wherein the film is fixedly joined to the internal portion of the external layer by gluing after a surface treatment of said film with a plasma process.

5. A tight-fitting garment according to claim 1, wherein at least one strip of film is removable at least once by the wearer, therefore allowing adjustment of its position by the wearer.

6. A tight-fitting garment according to claim 1 wherein the garment is adapted for underwater activities.

7. A tight-fitting garment according to claim 1, wherein the film is formed by a layer of glue which provides a slippery exterior surface when solidified.

8. A tight-fitting garment according to claim 1 in the form of a glove, wherein said internal film is applied internally in contact with one of the regions of the body belonging to the group consisting of the palm and the back of the hand.

9. A tight-fitting garment according to claim 1 in the form of a boot, wherein said internal film is applied internally in contact with one of the regions of the body belonging to the group consisting of the heel and the top of the foot.

10. A tight-fitting garment according to claim 1 in the form of a diving suit comprising at least eight strips of film, wherein two strips of film are secured to each of the arms and two strips are secured to each of the legs.

* * * * *